United States Patent [19]

Wheelock

[11] Patent Number: 4,664,084

[45] Date of Patent: May 12, 1987

[54] FUEL METERING SYSTEM

[75] Inventor: James G. Wheelock, Montrose, Ala.

[73] Assignee: Teledyne Industries, Inc., Los Angeles, Calif.

[21] Appl. No.: 760,134

[22] Filed: Jul. 29, 1985

[51] Int. Cl.[4] ..... F02M 39/00

[52] U.S. Cl. ..... 123/462; 123/458; 137/115; 251/129.11

[58] Field of Search ..... 123/494, 458, 460, 357–359, 123/462, 459; 137/625.11, 876, 554, 495, 115; 251/129.11; 318/203

[56] References Cited

U.S. PATENT DOCUMENTS

| | | | |
|---|---|---|---|
| 2,127,265 | 8/1938 | Martin | 251/129.11 |
| 2,642,077 | 6/1953 | Waterman | 251/129.11 |
| 2,902,016 | 9/1959 | Powell | 123/462 |
| 3,105,478 | 10/1963 | Lyon | 123/462 |
| 3,323,548 | 6/1967 | Ludwig | 251/129.11 |
| 4,048,964 | 9/1977 | Kissel | 123/357 |
| 4,070,604 | 1/1978 | Usry | 318/203 |
| 4,097,786 | 6/1978 | Lund | 251/129.11 |
| 4,154,425 | 5/1979 | Smith | 257/129.11 |
| 4,161,933 | 7/1979 | Stumpp | 123/452 |
| 4,194,478 | 3/1980 | Sumiyoshi et al. | 123/452 |
| 4,200,074 | 4/1980 | Kosuda et al. | 123/452 |
| 4,284,047 | 8/1981 | Stumpp | 123/449 |
| 4,304,211 | 12/1981 | Tezuka et al. | 123/585 |
| 4,338,902 | 7/1982 | Nakamura | 123/458 |
| 4,348,998 | 9/1982 | Stumpp | 123/447 |
| 4,462,372 | 7/1984 | Jackson | 123/462 |
| 4,465,046 | 8/1984 | May | 123/428 |
| 4,476,889 | 10/1984 | Hayes | 137/115 |

FOREIGN PATENT DOCUMENTS

| | | | |
|---|---|---|---|
| 0073967 | 3/1983 | European Pat. Off. | 123/506 |

*Primary Examiner*—Carl Stuart Miller

*Attorney, Agent, or Firm*—Gifford, Groh, VanOphem, Sheridan, Sprinkle and Dolgorukov

[57] ABSTRACT

A device for metering pressurized fuel from a fuel pump and to an engine. The device includes a housing having a fuel inlet port connected to the fuel pump, a fuel outlet port connected to the engine and a fuel return port connected to the fuel tank. A valve member is contained within the interior of the housing and is rotatable between a first position and a second position. The valve member includes a cam surface which variably restricts fluid passageways extending between the inlet port and both the return port and outlet port as a function of the rotational position of the valve member. A control system selectively activates a stepper motor to rotatably drive the valve member between its first and second rotational positions while a transducer coupled to the valve member provides a feedback signal to the control system indicative of the rotational position of the valve member.

8 Claims, 6 Drawing Figures

FUEL METERING SYSTEM

BACKGROUND OF THE INVENTION

I. Field of the Invention

The present invention relates generally to fuel systems for engines and, more particularly, to an electrically controlled fuel metering system.

II. Description of the Prior Art

In fuel delivery systems for internal combustion engines, and particularly aircraft engines, fuel is typically pumped from a fuel reservoir or tank to an inlet port on a fuel metering device. The fuel metering device includes an outlet port which is fluidly connected to the engine and a fuel return port which is fluidly connected to the fuel reservoir. A valve assembly contained within the fuel metering device variably fluidly connects the inlet port to the outlet and return ports in accordance with the fuel demanded by the engine operator. Thus, if additional fuel to the engine were required, the fuel metering device diverts a proportionately greater amoumt of fuel from its inlet port to the outlet port and less to its return port, and vice versa.

One disadvantage of these previously known fuel metering devices, however, is that the valve is controlled by a mechanical linkage extending from the engine operator and to the fuel metering device. This is disadvantageous in several different respects. First, the mechanical linkage increases the weight of the overall fuel system. This is particularly disadvantageous in weight critical applications, such as aircraft engines. Furthermore, the mechanical linkage requires periodic maintainance and inspection and is prone to failure.

A still further disadvantage of these previously known mechanically actuated fuel metering devices is that such devices require physical actuation by the engine operator. As such, these previously known devices are not easily adaptable to automated fuel delivery systems.

SUMMARY OF THE PRESENT INVENTION

The present invention provides a fuel metering device for a fuel delivery system which overcomes all of the above mentioned disadvantages.

In brief, the device of the present invention comprises a housing having a fuel inlet port, a fuel outlet port and a fuel return port. The fuel inlet port is fluidly connected to a source of pressurized fuel, such as the outlet from a pump, while the fuel outlet is connected to the fuel system for the engine. The fuel return line is fluidly connected to the fuel reservoir or fuel tank.

A valve member is contained within the interior of the housing and is rotatable between a first and second rotational positions. The valve member is designed to selectively restrict passageways formed in the housing and which extend between the inlet port and both the return and outlet ports. Furthermore, the valve member is operable, upon rotation, to variably restrict the passageway between the inlet port and outlet port in an amount inversely proportional to the passageway between the inlet port and return line. Consequently, rotation of the valve member in one direction delivers a porportionately greater amount of fuel to the engine and less fuel back to the fuel reservoir, and vice versa.

A stepper motor is mechanically connected to the valve member so that, upon activation, the stepper motor rotatably drives the valve member between its first and second positions. In doing so, the amount of fuel delivered to the engine varies proportionately as a function of the rotational position of the valve member.

Preferably, an electronic control system controls the activation of the stepper motor. In addition, a resolver or transducer is coupled to the valve member and provides an electrical feedback signal to the control system which is representative of the rotational position of the valve member. Consequently, the rotational position of the valve member, and thus the amount of fuel delivered to the engine, can be varied by the electronic control system without operator intervention.

BRIEF DESCRIPTION OF THE DRAWING

A better understanding of the present invention will be had upon reference to the following detailed description, wherein like reference characters refer to like parts throughout the several views and in which.

DETAILED DESCRIPTION OF A PREFERRED EMBODIMENT OF THE INVENTION

Figure 1:
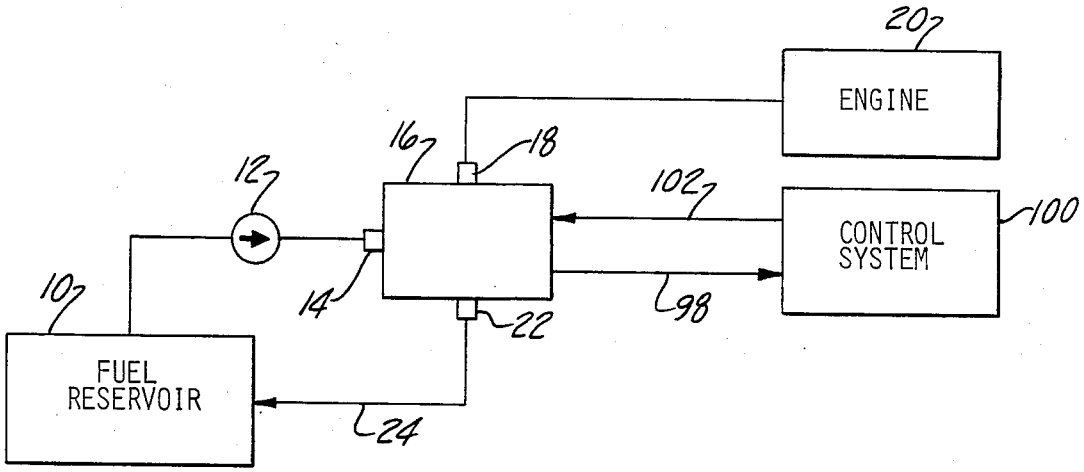
FIG. 1 is a diagrammatic view illustrating a preferred embodiment of the present invention.

With reference first to FIG. 1, a fuel delivery system is thereshown and comprises a fuel reservoir or fuel tank 10 having an outlet which is fluidly connected to the intake of a pump 12. The pump 12, when driven, provides pressurized fuel to an inlet port 14 of a fuel metering device 16.

The fuel metering device 16 includes an outlet port 18 which is fluidly connected to the fuel system of an engine 20. The engine 20 can be any conventional engine, such as a reciprocal piston internal combustion engine.

The metering device 16 further includes a return port 22 which is fluidly connected by a return line 24 to the fuel reservoir 10. As will be subsequently described in greater detail, the fuel metering device 16 variably diverts the fuel received at its inlet port 14 between its outlet port 18 and return port 22 in order to provide fuel to the engine 20. When the engine 20 requires additional fuel, the metering device 16 diverts a greater portion of the fuel from its inlet port 14 to its outlet port 18 and less fuel to its return port 22, and vice versa.

Figure 3:
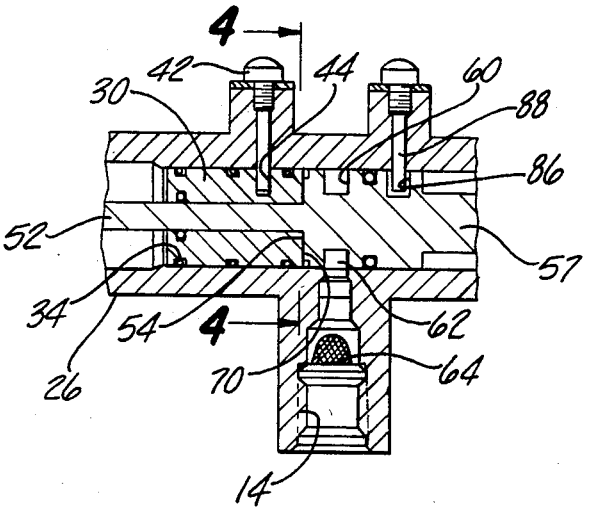
FIG. 3 is a view taken substantially along line 3—3 in FIG. 2.
Figure 2:
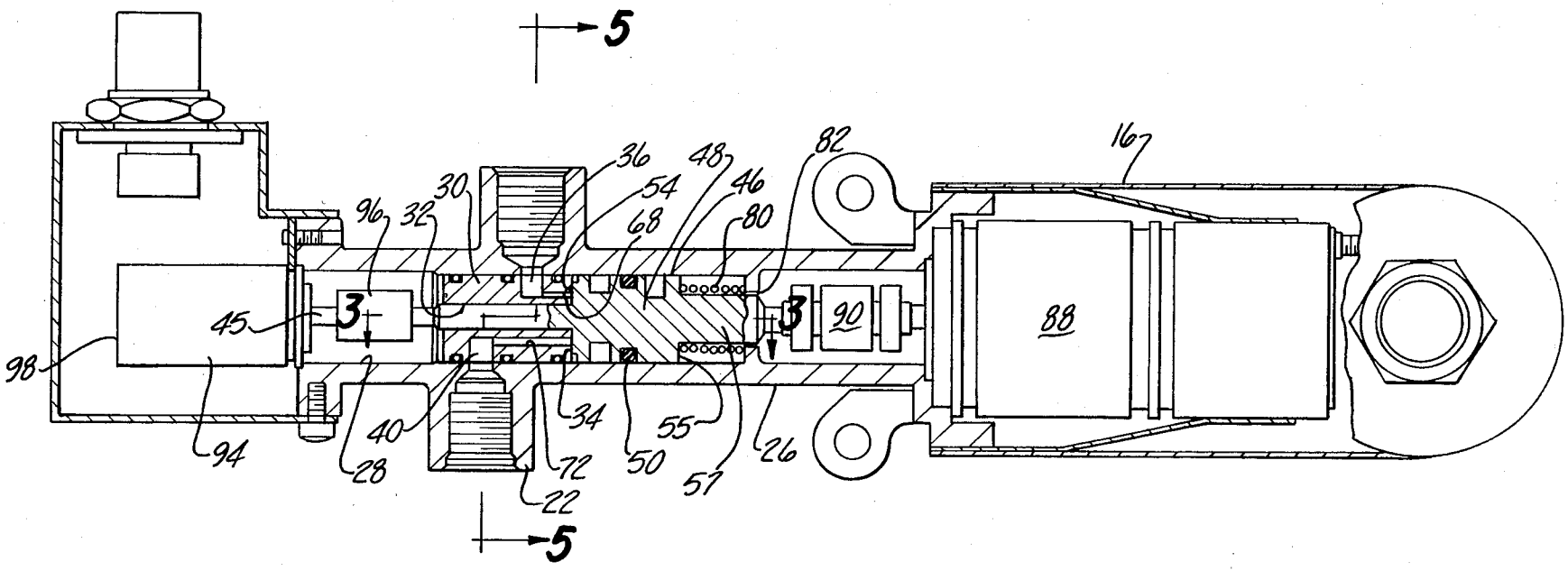
FIG. 2 is a longitudinal sectional view illustrating the preferred embodiment of the invention.

With reference now to FIGS. 2 and 3, the fuel metering device 16 is thereshown in greater detail and includes an elongated housing 26 having an elongated and generally cylindrical throughbore 28. Each fluid port 14, 18 and 22 is connected by conventional fluid fittings to the housing 26 so that each port is open to the throughbore 28.

Figure 5:
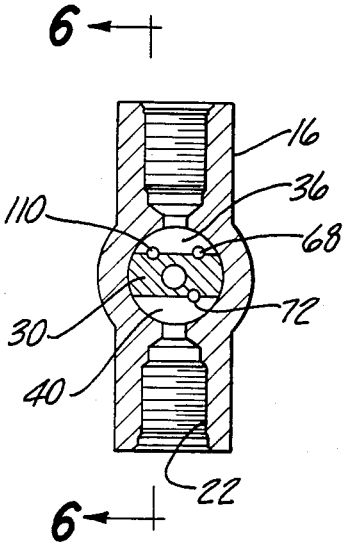
FIG. 5 is a sectional view taken substantially along line 5—5 in FIG. 2.

As best shown in FIGS. 2, 3 and 5, a cylindrical plug 30 having an axial throughbore 32 is contained within the housing throughbore 28 and is fluidly sealed to the throughbore 28 by O-rings 34. A cross cut in the plug 30 forms a first fluid chamber 36 (FIGS. 2 and 5) which registers with and is open to the outlet port 18. Similarly, a second cross cut in the plug 30 forms a second fluid chamber 40 which registers with and is open to the return line port 22. As best shown in FIG. 3, a screw 42 is threadably secured to the housing 26 and extends into a receiving bore 44 formed in the plug 30 to lock the plug 30 against both axial and rotational movement. Consequently, the chamber 36 remains in fluid communication with the outlet port 18 and the chamber 40 remains in fluid communication with the return line port 22.

With reference now particularly to FIGS. 2 and 3, an elongated valve member 46 is also contained within the housing throughbore 28. The valve member 46 includes a central spool 48 having an O-ring 50 which sealingly engages the interior of the housing throughbore 28. An elongated stem 52 extends axially outwardly from one end 54 of the spool 48 and through the plug throughbore 32. A reduced diameter cylindrical stub 57 extends axially outwardly from the opposite end 55 of the spool 48.

Figure 4:
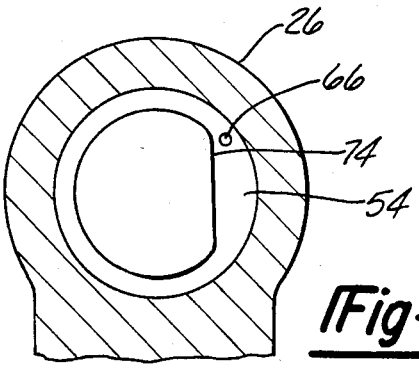
FIG. 4 is a cross sectional view taken substantially along line 4—4 in FIG. 3.

With reference now to FIGS. 3 and 4, the fuel inlet port 14 registers with an annular fluid chamber 62 formed in the valve spool 48. Preferably, a filter screen 64 is contained within the port 14 in order to remove any incoming debris from the fuel pump 12. Furthermore, the annular chamber 62 is fluidly connected with the end 54 of the valve spool 48 by one or more axial passageways 66 formed through the valve member 46.

With reference now to FIG. 5, a first axial passageway 68 extends through the plug 30 from the chamber 36 and to an end 70 (FIG. 3) of the plug 30 which faces the end 54 of the valve spool 48. Similarly, a second passageway 72 extends axially through the plug 30 from the fluid chamber 40 open to the return port 22 and to the same end 70 of the plug 30. The passageways 68 and 72 in the plug 30, together with the passageway 66 in the valve spool 48, provides the means for fluidly connecting the inlet port 14 to both the outlet port 18 and return port 22.

As best shown in FIG. 4, a cam surface 74 is formed on the end 54 of the valve spool 48. This cam surface 74 variably restricts the passageways 68 and 72 in the plug 30 as a function of the rotational position of the valve member 46 by variably covering the open ends of the passageways 68 and 72. Furthermore, the restriction or closure of the passageway 68 by the cam surface 74 is inverse to the closure or restriction of the port 72 by the cam surface 74. Consequently, as the valve member 46 rotates in one direction, the restriction of the passageway 68 increases while the restriction of the passageway 72 decreases, and vice versa. As a result, rotation of the valve member 46 in one rotational direction increases the fuel supply to the engine 20 (FIG. 1) and decreases the amount of fuel returned along the return line 24 to the reservoir 24. Rotation of the valve member 46 in the opposite direction reduces the amount of fuel supplied from the inlet port 14 and to the outlet port 18 and increases the amount of fuel returned from the port 22 and return line 24 to the reservoir 10.

Referring again to FIG. 2, a helical compression spring 80 is disposed around the reduced diameter stub 57 of the valve member 46 and is sandwiched between the end 57 of the valve spool 48 and a radially inwardly extending portion 82 of the housing 26. The spring 80 is in a state of compression which urges the end 54 of the valve spool 48 against the plug end 70 to create a mechanical fluid seal between the facing ends of the plug 30 and valve member 46.

With reference now particularly to FIG. 3, an arcuate groove 86 is formed along a circumferential portion, for example 100°, of the outer periphery of the valve spool 48. A pin 88 threadably engages the housing 26 so that the pin 88 extends into the groove 86. The pin 88 thus limits the rotational travel of the valve member 46 between a first and second position as defined by the ends of the annular groove 86.

Figure 6:
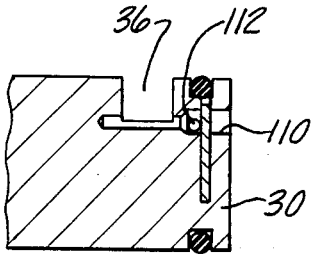
FIG. 6 is a sectional view taken substantially along line 6—6 in FIG. 5.

With reference now particularly to FIGS. 5 and 6, a relief fluid passageway 110 is provided axially through the plug 30 between the first or outlet chamber 36 and plug end 70. A ball check valve 112 is contained within the passageway 110 and fluidly closes the passageway 110 whenever the fluid pressure at the inlet port 14 exceeds the fluid pressure at the outlet chamber 36. However, in the event that the pressure in the outlet chamber 36 exceeds the pressure at the inlet port 14, as might occur after engine shutdown, the ball check valve 112 opens and relieves the excess fluid pressure at the outlet chamber 36 back to the inlet port 14.

With reference now to FIG. 2, in order to rotate the valve member 46 between its first and second rotational positions, and thus to vary the amount of fuel provided to the outlet port 18 and return port 22, the fuel metering device includes a controllable motor 88, such as a stepper motor, which is mounted to the housing 26 adjacent one end of the valve member 46. The stepper motor 88 is mechanically connected to the valve member stub 57 through a coupling 90 so that activation of the stepper motor 88 rotatably drives the valve member 46. In addition, the couling 82 is preferably a universal joint to prevent binding between the stepper motor 88 and the valve member 46.

Still referring to FIG. 2, a resolver or rotational position transducer 94 having an input shaft 95 is mechanically connected by a coupling 96 to the valve member stem 52 so that the resolver shaft 95 rotates in unison with the valve member 46. The resolver 94 can be of any conventional construction and provides an electrical signal on its output 98 which is representative of the rotational position of the valve member 46.

With reference again to FIG. 1, a control system 100 is employed to selectively activate the stepper motor 88 via an output line 102 as well as receive input signals from the resolver 94 from the resolver output line 98. The control system 100 is preferably microprocessor based and can be programmed to vary the fuel delivery to the engine 20 by rotating the valve member 46 between its first and second rotational positions via the stepper motor 88. Similarly, the output signal from the resolver 94 provides a feedback signal to the control system 100 indicative of the rotational position of the valve member 46.

From the foregoing, it can be seen that the present invention provides a fuel metering device for an internal combustion engine in which the fuel flow can not only be accurately controlled to follow a preprogrammed schedule as desired, but also which eliminates all the mechanical linkage between the metering device and the engine operator. As such, the metering device of the present invention not only reduces the overall weight of the fuel system and eliminates the previously known maintenance required with mechanical linkage systems, but also enables the metering device to be physically located at positions remote from the engine operator and at any desired orientation relative to the operator.

Having described my invention, however, many modifications thereto will become apparent to those skilled in the art to which it pertains without deviation from the spirit of the invention as defined by the scope of the appended claims.

I claim:

1. A device for metering pressurized fuel from a fuel source to an engine comprising:

a housing, said housing having a fuel inlet port adapted for connection to the fuel source, a fuel outlet port adapted for connection to the engine, and a fuel return line adapted for connection to the fuel source, a first passageway in said housing extending between said inlet port and said outlet port, a second fluid passageway extending between said inlet port and said return port, a valve member rotatably mounted in said housing between a first and second position, said valve member having an axial end and a cam formed on said axial end of said valve member, said first and second passageways being open to said axial end of said valve member, said cam forming means responsive to the rotational position of said valve member for simultaneously variably restricting said passageways in amounts substantially inversely proportional to each other, wherein said first passageway and said second passageway are substantially the same in crossectional shape so that the total crossectional area of said first and second passageways open by said cam remains substantially constant regardless of the rotational position of the cam, and an electric controllable motor having an output shaft coupled to said valve member for rotating said valve member between said first and second positions.

2. The invention as defined in claim 1 wherein said motor is a stepper motor.

3. The invention as defined in claim 2 and comprising a transducer coupled to said valve member which produces an electrical output signal representative of the rotational position of said valve member.

4. The invention as defined in claim 1 and comprising a plug in said housing, said passageways being formed in part through said plug and open to an end of said plug, and wherein said cam on said valve member abuts against said end of said plug.

5. The invention as defined in claim 4 and comprising means for resiliently urging said valve member against said end of said plug.

6. The invention as defined in claim 1 and comprising means for fluidly connecting said outlet port to said inlet port whenever the fluid pressure at said outlet port exceeds the fluid pressure at the inlet port.

7. The invention as defined in claim 6 wherein said means for fluidly connecting outlet port to said inlet port whenever the fluid pressure at said outlet port exceeds the fluid pressure at the inlet port comprises a ball check valve.

8. The invention as defined in claim 3 wherein said stepper motor is connected to one end of said valve member and said transducer is connected to the opposite end of said valve member.

* * * * *